US010850965B2

(12) United States Patent
Sweezey et al.

(10) Patent No.: US 10,850,965 B2
(45) Date of Patent: Dec. 1, 2020

(54) NEEDLE FOR ACCESSING A BEVERAGE IN CONTAINER

(71) Applicant: Coravin, Inc., Burlington, MA (US)

(72) Inventors: Andrew S. Sweezey, Malden, MA (US); Michael Rider, Lowell, MA (US)

(73) Assignee: Coravin, Inc., Bedford, MA (US)

( * ) Notice: Subject to any disclaimer, the term of this patent is extended or adjusted under 35 U.S.C. 154(b) by 83 days.

(21) Appl. No.: 16/211,709

(22) Filed: Dec. 6, 2018

(65) Prior Publication Data

US 2019/0185310 A1 Jun. 20, 2019

Related U.S. Application Data

(60) Provisional application No. 62/598,650, filed on Dec. 14, 2017.

(51) Int. Cl.

| | |
|---|---|
| ***B67D 1/04*** | (2006.01) |
| ***B67D 1/00*** | (2006.01) |
| ***B67B 7/00*** | (2006.01) |
| ***B67D 1/08*** | (2006.01) |

(52) U.S. Cl.

CPC ..... *B67D 1/0412* (2013.01); *B67B 7/26* (2013.01); *B67D 1/0004* (2013.01); *B67D 1/0042* (2013.01); *B67D 1/0802* (2013.01); *B67D 1/0885* (2013.01); *B67D 2001/0481* (2013.01); *B67D 2001/0487* (2013.01); *B67D 2001/0812* (2013.01); *B67D 2001/0825* (2013.01)

(58) Field of Classification Search

CPC ..... B67D 7/26; B67D 1/0004; B67D 1/0042; B67D 1/0802; B67D 1/0885

See application file for complete search history.

(56) References Cited

U.S. PATENT DOCUMENTS

| | | | | |
|---|---|---|---|---|
| 8,225,959 | B2 | 7/2012 | Lambrecht | |
| 2005/0178801 | A1* | 8/2005 | Lambrecht | B67D 7/0272 222/399 |
| 2010/0006603 | A1* | 1/2010 | Weinberg | B67D 1/0885 222/152 |
| 2010/0331868 | A1 | 12/2010 | Bardy | |
| 2012/0083727 | A1 | 4/2012 | Barnett | |
| 2013/0292423 | A1* | 11/2013 | Lambrecht | B67D 1/0004 222/399 |

(Continued)

FOREIGN PATENT DOCUMENTS

EP 2 165 967 A1 3/2010

OTHER PUBLICATIONS

International Search Report and Written Opinion for International Application No. PCT/US2018/065093, dated Apr. 4, 2019.

*Primary Examiner* — Jeremy Carroll

(74) *Attorney, Agent, or Firm* — Wolf, Greenfield & Sacks, P.C.

(57) ABSTRACT

A needle for accessing a container having a closure, such as a cork of a wine bottle. The needle includes first and second lumens each having a D-shaped cross section and a flat surface. The first and second lumens are attached with the flat surfaces in contact, and each lumen may have an outlet opening at a distal end. The needle may be used with a beverage dispenser that operates by introducing gas into a container via one lumen, and receives beverage from the container via another one of the lumens.

19 Claims, 7 Drawing Sheets

(56) References Cited

U.S. PATENT DOCUMENTS

| | | | | |
|---|---|---|---|---|
| 2014/0097198 | A1* | 4/2014 | Lazaris | B67D 1/0809 222/5 |
| 2014/0103065 | A1 | 4/2014 | Lambrecht et al. | |
| 2014/0252046 | A1* | 9/2014 | Rider | B67D 1/0412 222/399 |
| 2014/0367415 | A1* | 12/2014 | Rider | F16K 17/0406 222/5 |
| 2015/0313579 | A1 | 11/2015 | Householder et al. | |

* cited by examiner

NEEDLE FOR ACCESSING A BEVERAGE IN CONTAINER

RELATED APPLICATION

This Application claims priority under 35 U.S.C. § 119(e) to U.S. Provisional Application Ser. No. 62/598,650, entitled "NEEDLE FOR ACCESSING A BEVERAGE IN CONTAINER," filed Dec. 14, 2017, which is herein incorporated by reference in its entirety.

BACKGROUND OF INVENTION

This invention relates generally to the dispensing or other extraction of fluids from within a container, e.g., the dispensing of wine from a wine bottle.

SUMMARY OF INVENTION

One or more embodiments in accordance with aspects of the invention allow a user to withdraw or otherwise extract a beverage, such as wine, from within a container that is sealed by a cork, plug, elastomeric septum or other closure without removing the closure. In some cases, removal of liquid from such a container may be performed one or more times, yet the closure may remain in place during and after each beverage extraction to maintain a seal for the container. Thus, the beverage may be dispensed from the bottle multiple times and stored for extended periods between each extraction with little or no effect on beverage quality. In some embodiments, little or no gas, such as air, which is reactive with the beverage may be introduced into the container either during or after extraction of beverage from within the container. For example, a needle may be inserted through the cork or other closure to introduce pressurized gas into the container and to conduct wine or other beverage liquid out of the container. After dispensing is complete, the needle may be withdrawn from the cork, which reseals in the area where the needle penetrated. Thus, in some embodiments, a user may withdraw wine from a wine bottle without removal of, or damage to, the cork, and without allowing air or other potentially damaging gasses or liquids entry into the bottle.

In one aspect of the invention, a needle for accessing a beverage in a container includes a first lumen having a first cross sectional size and a first D-shaped cross section with a first flat surface, and a second lumen having a second cross sectional size and a second D-shaped cross section with a second flat surface. The second cross sectional size may be smaller than the first cross sectional size, e.g., the second lumen may have a smaller cross sectional area than the first lumen. The first and second lumens may each extend from a proximal end to a distal end and be attached together with the first and second flat surfaces in contact with each other. For example, the lumens may be made of a metal and welded or brazed together along a portion of the length of the lumens at the opposed flat surfaces. A hub may be attached at the proximal ends of the first and second lumens, and the hub may be arranged to connect the first and second lumens to a beverage dispenser and put at least one of the first and second lumens in fluid communication with a portion of the beverage dispenser. For example, the hub may include one or more ports or openings that are in respective fluid communication with the first and second lumens. The ports or openings may be fluidly connected with a beverage dispenser, e.g., so a pressurized gas source is fluidly coupled to the second lumen and a beverage dispensing outlet is fluidly coupled to the first lumen. The second lumen may be used to inject pressurized gas into a bottle, and in response beverage may exit the bottle via the first lumen.

In some embodiments, a pointed end, e.g., a single pointed end, may be provided at the distal ends of the first and second lumens. As noted above, the first and second lumens may be constructed and arranged to penetrate through a cork of a wine bottle by inserting the pointed end through the cork. In some cases, the hub may be constructed and arranged to support the first and second lumens to penetrate through a cork of a wine bottle such that only the hub may be held and used to force the first and second lumens through the cork.

In some embodiments, the first lumen includes a first opening at a distal end of the first lumen to receive beverage liquid into the first lumen, and the second lumen includes a second opening at a distal end of the second lumen to deliver gas into the container. The first and second openings may be on opposed sides of the needle relative to each other, e.g., to help prevent crosstalk between the openings. The first opening may be larger than the second opening, e.g., because the first opening is arranged to handle the flow of liquid whereas the second opening is arranged to handle the flow of gas. In some cases, the first and second openings may be elongated, e.g., having an oval shape, and extend in a direction along a length of the first and second lumens.

In another aspect of the invention, first and second lumens of a needle may define a cross sectional shape with a major dimension that extends along a major axis and is a largest dimension of the cross sectional shape. In some embodiments, the cross sectional shape may have a minor dimension along a minor axis that is perpendicular to the major axis that is smaller than the major dimension of the cross sectional shape. For example, the overall cross sectional shape of the needle may have an oval or other shape that is generally larger in a first direction than in another second direction perpendicular to the first direction. This arrangement may aid in cork or other closure reseal upon withdrawal of the needle. In some embodiments, first and second openings for handling gas and beverage flow may be centered or otherwise positioned on respective lines arranged at an angle of 50 to 90 degrees to the major axis, e.g., so as to position the openings in areas away from where the cork contacts the needle with the greatest force during needle insertion. In some cases, the first and second openings may be centered on respective lines arranged at an angle of 60 to 70 degrees to the major axis, and the openings may be arranged on opposite sides of the needle.

In another aspect of the invention, a needle for accessing a beverage in a container includes at least one lumen defining a cross sectional shape and extending from a proximal end to a distal end. The cross sectional shape may have a major dimension along a major axis and a minor dimension along a minor axis that is perpendicular to the major axis, with the minor dimension being smaller than the major dimension. For example, the needle may include a single lumen that has a cross sectional shape with a minor axis dimension smaller than a major axis dimension. Alternately, the needle may have two or more lumens that are attached together and that together define a cross sectional shape with a minor axis dimension smaller than a major axis dimension. A ratio of the major dimension to the minor dimension may be 1.25 to 1 or more, e.g., 4 to 1. The needle may be configured to be inserted through a cork of a wine bottle along a pathway through the cork such that the distal end of the at least one lumen passes entirely through the cork. The needle may be configured to allow the cork to reseal to resist passage of fluid through the pathway upon withdrawal of the needle from the cork. This may allow the needle to be used in accessing wine or other beverage in a closed bottle without removing a cork or other closure, while also allowing the cork or other closure to reseal when the needle is withdrawn.

In accordance with other aspects of the invention, a needle may include a hub with a body having a gas port that extends through the body and fluidly communicates with the second lumen. This may allow the hub to fluidly couple the second lumen with a gas source of a beverage dispenser. In one embodiment, the hub includes a first gasket positioned distal of the port and a second gasket positioned proximal of the gas port. These gaskets may form a respective seal with the dispensing device to provide a leak-tight coupling of the second lumen to a gas source.

In some embodiments, the hub includes a body with first and second tabs that extend away from each other in a direction perpendicular to a length of the first and second lumens. The first tab may be longer than the second tab, e.g., so that the hub can be received by a dispensing device in only a single orientation. The hub body may have an opening at a proximal end of the body, which is fluid communication with the first lumen and allows the first lumen to be fluidly coupled to a beverage dispensing outlet of the device.

Various exemplary embodiments of the device are further depicted and described below.

BRIEF DESCRIPTION OF THE DRAWINGS

Aspects of the invention are described with reference to various embodiments, and to the figures, which include.

DETAILED DESCRIPTION

Figure 1:
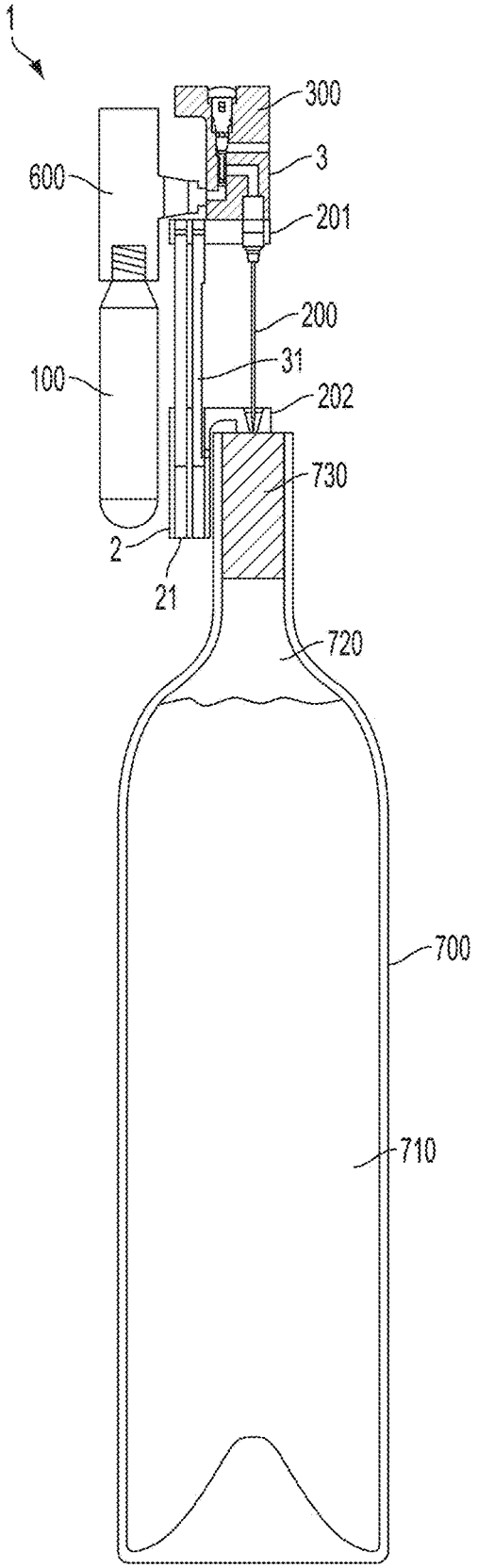
FIG. 1 shows a sectional side view of a beverage extraction device in preparation for introducing a needle through a closure of a beverage container.

Aspects of the invention are described below with reference to illustrative embodiments, but it should be understood that aspects of the invention are not to be construed narrowly in view of the specific embodiments described. Thus, aspects of the invention are not limited to the embodiments described herein. It should also be understood that various aspects of the invention may be used alone and/or in any suitable combination with each other, and thus various embodiments should not be interpreted as requiring any particular combination or combinations of features. Instead, one or more features of the embodiments described may be combined with any other suitable features of other embodiments.

FIGS. 1-4 show schematic views of one embodiment of a beverage extraction device 1 that may incorporate one or more aspects of the invention, e.g., may be used with a needle having features described more below. This illustrative system 1 includes a body 3 with an attached pressurized source of gas 100 (such as a compressed gas cylinder) that provides gas under pressure (e.g., 2600 psi or less as dispensed from the cylinder) to a regulator 600. In this arrangement, the cylinder 100 is secured to the body 3 and regulator 600 by a threaded connection, although other configurations are possible, such as those described below and/or in U.S. Pat. Nos. 4,867,209; 5,020,395; and 5,163,909 which are hereby incorporated by reference with respect to their teachings regarding mechanisms for engaging a gas cylinder with a cylinder receiver. The regulator 600 is shown schematically and without detail, but can be any of a variety of commercially available or other single or multi-stage pressure regulators capable of regulating gas pressures to a pre-set or variable outlet pressure. The main function of the regulator 600 is to provide gas at a pressure and flow rate suitable for delivery to the container 700 (such as a wine bottle), e.g., so that a pressure established inside the container 700 does not exceed a desired level.

In this embodiment, the body 3 also includes a valve 300 operable to control the flow of gas from the regulator 600. The valve 300 may be a 3-way toggle valve that includes a single operation button and functions to selectively introduce pressurized gas into the container 700 and extract beverage 710 (such as wine) from the container 700 via a needle 200. Details regarding the operation of such a valve 300 are provided in U.S. Pat. No. 8,225,959, which is incorporated by reference in its entirety. Of course, other valve arrangements for controlling pressurized gas and beverage flow are possible. For example, the 3-way valve 300 could be replaced with a pair of on/off valves, one for controlling gas introduction to the container 700, and another for controlling flow of beverage from the container 700. Each valve could have its own actuator, allowing a user to selectively open and close the valves, whether individually or simultaneously. In short, details regarding the operation of the regulator 600 and valve 300 or other mechanisms for introducing gas into a container, and removing beverage from the container 700 are not necessarily limitations on aspects of the invention and may be modified as suitable.

To introduce gas into the container 700 and extract beverage, a needle 200 attached to the body 3 is inserted through a cork or other closure 730 that seals an opening of the container 700. Details regarding needle configurations are discussed in more detail below. While the needle 200 may be inserted into the cork or other closure 730 in different ways, in this embodiment, the system 1 includes a base 2 with a pair of channels 21 that receive and guide movement of respective rails 31 of the body 3. Thus, movement of the body 3 and attached needle 200 relative to the container closure 730 may be guided by the base 2, e.g., the body 3 may slide vertically relative to the base 2 to move the needle 200 into/out of the closure 730. In addition, movement of the needle 200 may be guided by a needle guide 202 that is attached to the base 2 and positioned over the closure 730. Other arrangements for guiding movement of the body 3 relative to the base 2 are possible, such as providing one or more rails on the base 2 which engage with a channel or other receiver of the body 3, providing an elongated slot, channel or groove on the body or base which engages with a corresponding feature (e.g., a tab) on the other of the body or base and allows for sliding movement, a linkage that connects the body and base together and allows for movement of the body to insert the needle into the closure, and others.

In some embodiments, the base 2 may be fixed or otherwise held in place relative to the container 700, e.g., by a clamp arm, sleeve, strap or other device that engages with the container 700. Clamp arrangements may be used to temporarily or releasably secure the device 1 to a wine bottle neck or other container 700. By restraining movement of the base 2 relative to the container 700, such an arrangement may help guide motion of a needle 200 relative to the container 700 when penetrating a closure 730, or when being withdrawn from the closure 730. Alternately, the container 700 may be manipulated by grasping and manipulating the device 1 since the clamp engaging the device 1 to the container 700 may securely hold the device 1 and container 700 together.

Figure 2:
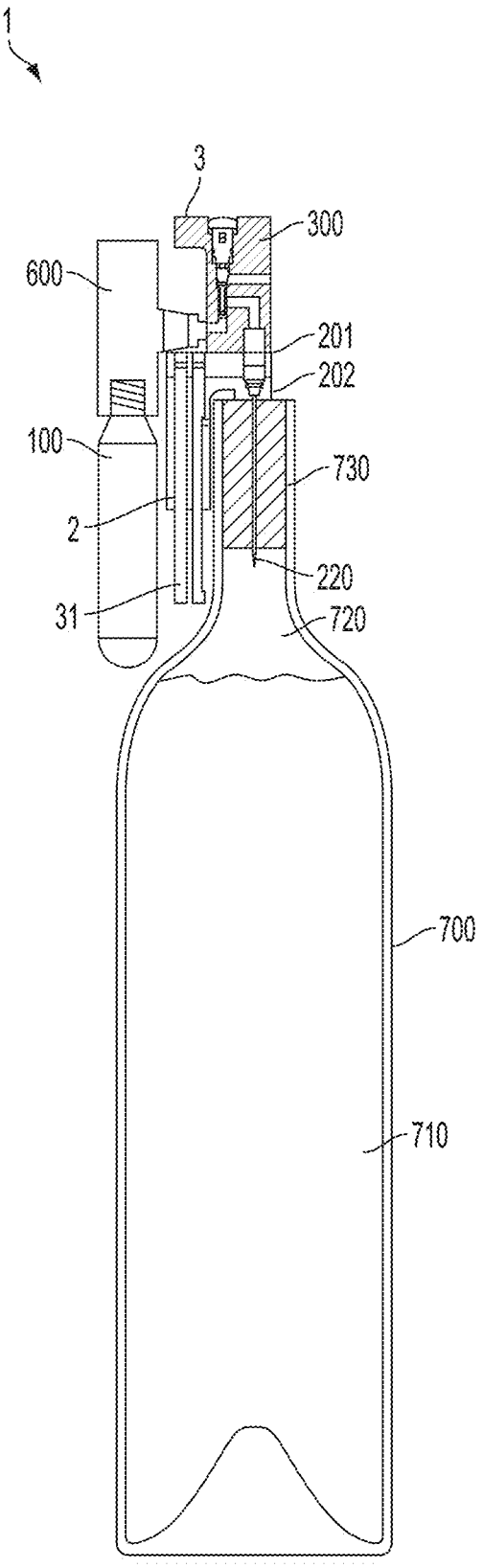
FIG. 2 shows the FIG. 1 embodiment with the needle passed through the closure.
Figure 3:
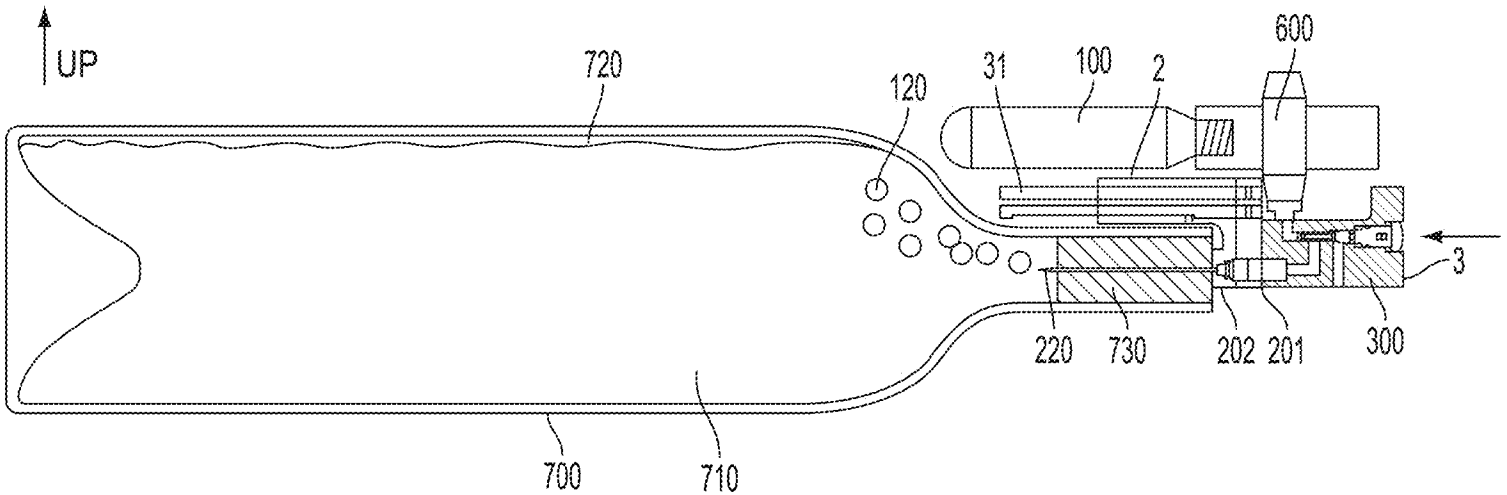
FIG. 3 shows the FIG. 1 embodiment while introducing gas into the container.
Figure 4:
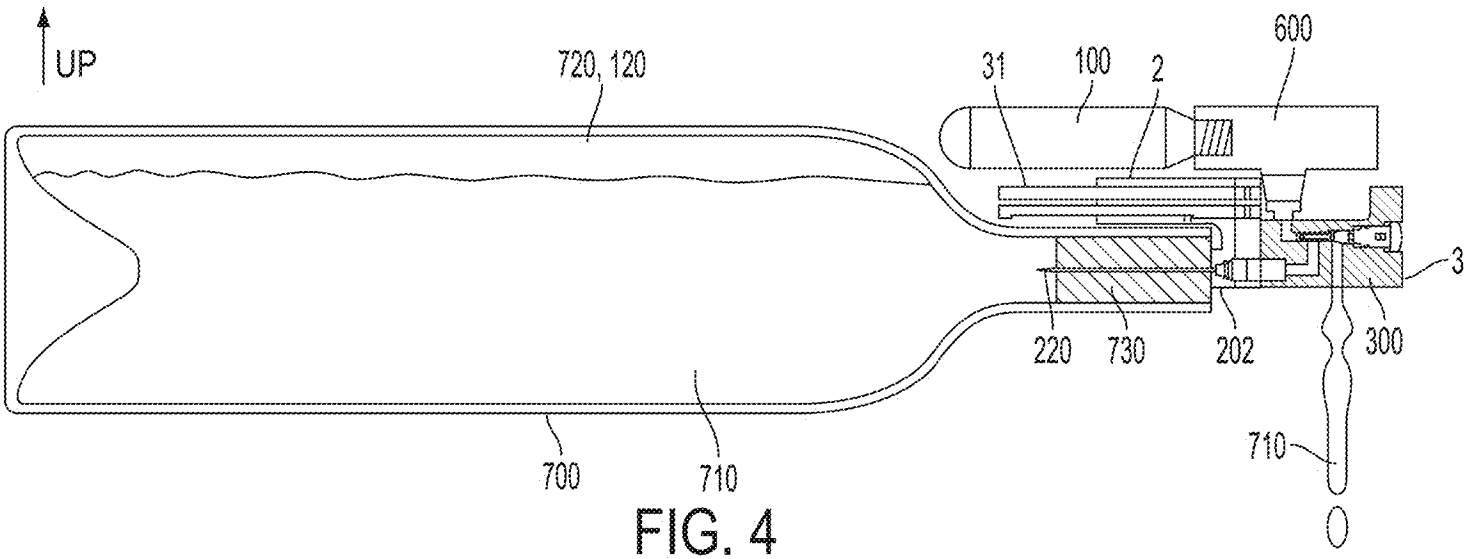
FIG. 4 shows the FIG. 1 embodiment while dispensing beverage from the container.
Figure 5:
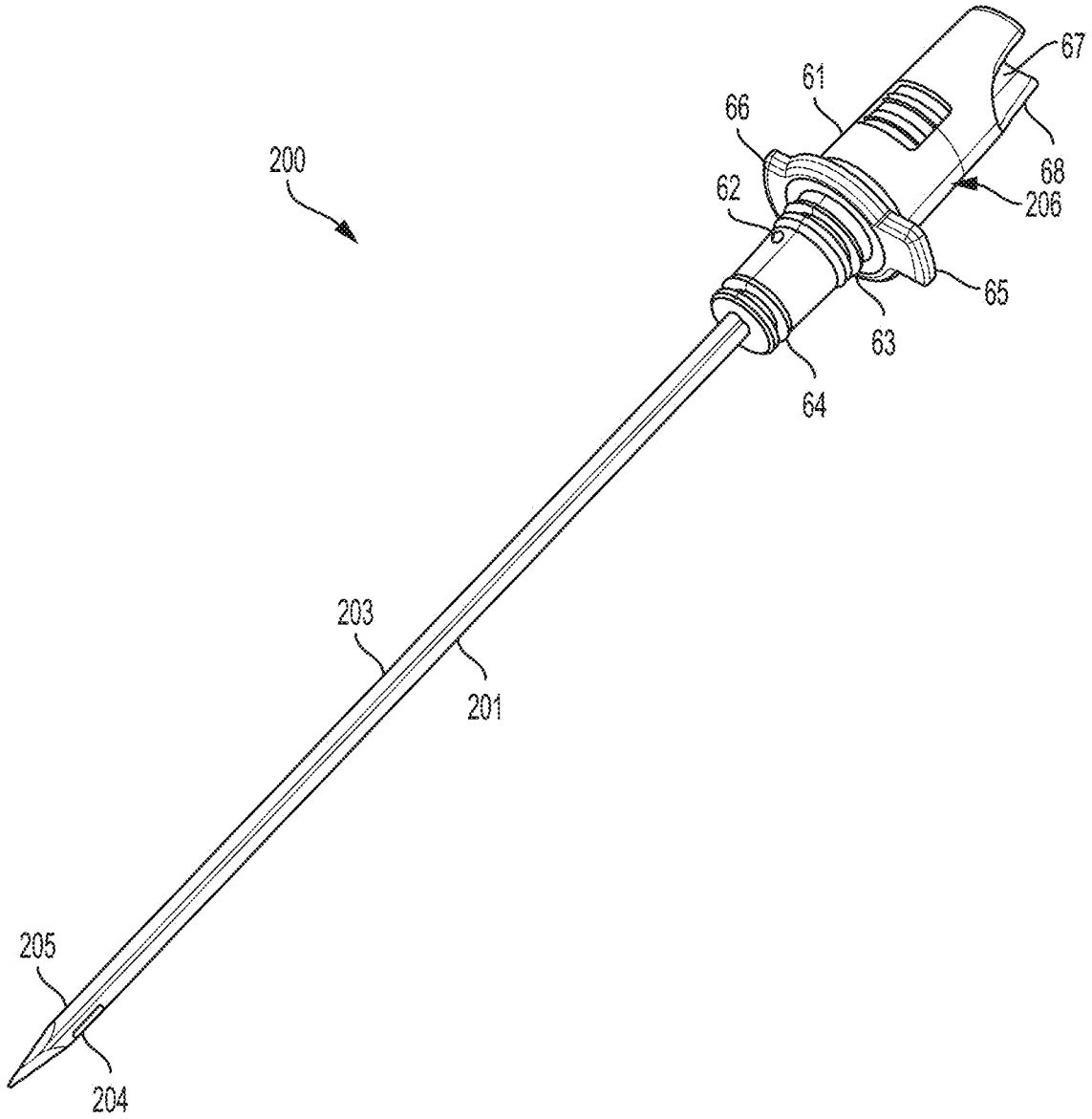
FIG. 5 shows a perspective view of a needle in an illustrative embodiment.
Figure 6:
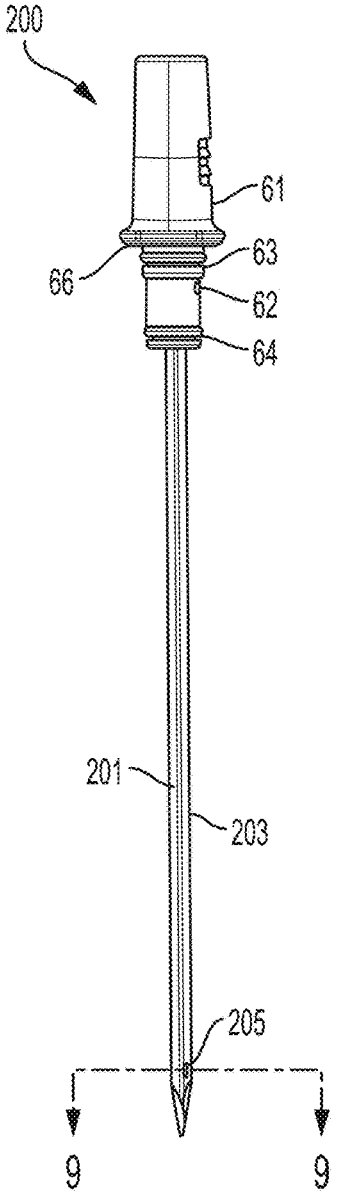
FIG. 6 shows a front view of the needle of FIG. 5.
Figure 7:
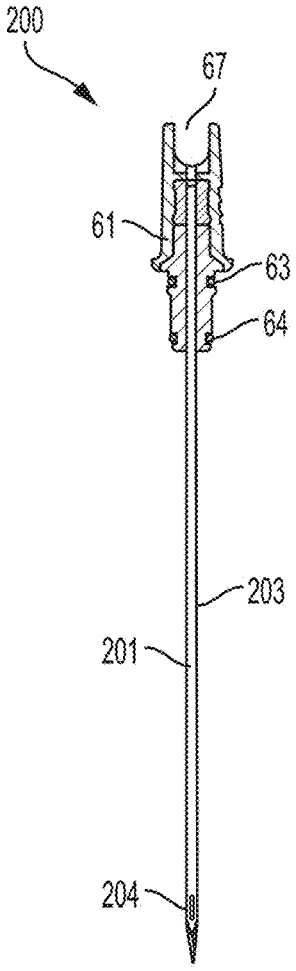
FIG. 7 shows a cross sectional view of the FIG. 5 needle along the line 7-7 in FIG. 8.
Figure 8:
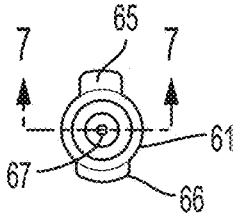
FIG. 8 is a top view of the FIG. 5.

To insert the needle 200 through the closure 730, a user may push downwardly on the body 3 while maintaining the base 2 and the container 700 at least somewhat stationary relative to each other. The needle 200 will pass through the closure 730, guided in its motion, at least in part, by the guided motion of the body 3 relative to the base 2 (e.g., by the rails 31 and channels 21). With the needle 200 suitably inserted as shown in FIG. 2, one or more needle openings 220 at the distal end of the needle may be positioned below the closure 730 and within the enclosed space of the container 700. The container 700 may then be tilted, e.g., so that the beverage 710 flows to near the closure 730 and any air or other gas 720 in the container 700 flows away from the closure. Pressurized gas 120 may then be introduced into the container 700 by actuating the valve 300 and causing gas from the cylinder 100 to flow through the valve 300 and needle 200 to exit into the container 700, as shown in FIG. 3. Alternately, pressurized gas 120 can be introduced into the container 700 prior to tilting of the container, followed by tilting and dispensing of beverage. Thereafter, the valve 300 may be operated to stop the flow of pressurized gas and allow beverage 710 to flow into the needle 200 to be dispensed from the valve 300, as shown in FIG. 4. Thus, beverage may flow through a conduit of the body 3 that in this embodiment includes the needle 200, passageways in the body 3, and the valve 300. Of course, other arrangements for a conduit of a body 3 to conduct the flow of beverage are possible.

As discussed above, the beverage extraction device 1 may include a needle that has first and second lumens, e.g., one lumen for beverage flow and another lumen for gas flow. The extraction device 1 is shown schematically in FIGS. 1-4 as having a single conduit or flow path that communicates with the needle 200, but it should be understood that the device 1 may have two separate conduits for fluid communication with the needle 200, i.e., one conduit or flowpath for gas supply to the needle and another for receiving beverage from the needle. A single valve may be used to control flow through each of the gas and beverage conduits, or two valves may be used (one each for a corresponding gas or beverage conduit), or single valve may be used to control flow in only one conduit (e.g., a single valve may control only gas flow to the needle, or only beverage flow from the needle). For example, the needle 200 may have a first lumen for conducting beverage from the container and a second lumen for delivering gas to the container. A valve may control gas flow in a gas conduit coupled to the second lumen to pressurize the container interior, and in response beverage may flow out of the container via the first lumen. Flow of beverage in the first lumen may be stopped or slowed by stopping gas flow into the container.

FIGS. 5-10 show a needle that incorporates one or more aspects of the invention. In this illustrative embodiment, the needle 200 includes a first lumen 201 and a second lumen 203. The first and second lumens 201, 203 extend from a proximal end to a distal end, and respectively have first and second openings 204, 205 at a distal end. In this embodiment, the first lumen 201 is arranged to carry a flow of beverage liquid received at the first opening 204, through the first lumen 201 and to a dispensing outlet of the extraction device 1. The second lumen 203 is arranged to carry a flow of pressurized gas from a gas source (such as the gas cylinder 100) to the second opening 205, e.g., to deliver gas and pressurize the interior of a bottle. Because the first lumen 201 is arranged carry a flow of liquid, the first lumen 201 may have a larger cross sectional area (where the cross section is taken in a plane perpendicular to the length of the needle 200) than the second lumen 203, which carries a flow of gas. The larger cross sectional area of the first lumen 201 may help reduce a resistance to flow of liquid, and thus help support a higher flow rate as compared to a lumen having a smaller cross sectional area. However, it is not necessary for the first and second lumens 201, 203 to have a different cross sectional area or other size.

In this illustrative embodiment, and in accordance with aspects of the invention, the needle includes a hub 206 attached at the proximal ends of the first and second lumens 201, 203. The hub 206 may be arranged to facilitate connection or other coupling of the first and second lumens 201, 203 to corresponding flow channels or conduits of the extraction device 1. For example, the hub 206 in this case includes a body 61 with a gas port 62 that extends through the body 61 and fluidly communicates with the second lumen 203. The gas port 62 may be arranged to couple with a corresponding port or other structure of the extraction device 1 to fluidly connect the gas source with the second lumen 203. In this embodiment, the hub 206 includes a first gasket 63 positioned proximally of the gas port 62 and a second gasket 64 positioned distally of the gas port 62. This arrangement may allow the hub 206 to be received into a cylindrically shaped receiving opening or hole of the device 1 so that the first and second gaskets 63, 64 sealingly engage with corresponding portions of the receiving hole. As a result, the gas port 62 may be fluidly coupled with a space in the receiving hole that is fluidly coupled to the gas source. Of course, other arrangements are possible for fluidly coupling a gas port 62 to a gas source, such as an o-ring or other gasket positioned around the opening of the gas port 62 that sealingly engages with a corresponding port or other opening when the hub 206 is received by the extraction device 1, a threaded connection of the hub 206 to the device 1, and so on.

In this embodiment, the hub 206 also includes first and second tabs 65, 66 that extend away from each other in a direction perpendicular or otherwise transverse to a length of the first and second lumens 201, 203. These tabs 65, 66 may engage with corresponding slots or other openings of the extraction device 1 when the hub 206 is engaged by the device 1, e.g., to help resist rotation of the needle 200 relative to the device 1 about axes that are parallel to the length of the needle 200, or other movement of the needle 200, such as in a direction along the length of the needle. Thus, the tabs 65, 66 may provide bayonet-type engagement features that help serve to lock the hub 206, and therefore the needle 200, to the device 1 in at least one range of motion.

In this illustrative embodiment, the first tab 65 is longer than the second tab 66. This feature may help ensure that the hub 206 is positioned in a particular way with respect to the device 1 when the needle 200 is engaged with the device 1. For example, a receiving hole of the device 1 may include a first and second slots that respectively receive and engage with the first and second tabs 65, 66. The first slot may be longer than the second slot so that the hub 206 can only be received with the first tab 65 in the first slot. Engagement of the tabs 65, 66 with the slots may help resist rotation of the hub 206 relative to the device 1. The second tab 66 is wider than the first tab 65 in this embodiment, and this feature may be exploited as well to help ensure proper orientation of the hub 206 with the device 1.

The hub 206 in this illustrative embodiment also includes an opening 67 at a proximal end of the body 61 that is in fluid communication with the first lumen 201. The body 61 and opening 67 may be arranged to facilitate fluid coupling of the first lumen 201 with a dispensing outlet of the device 1. For example, the device 1 may include a cap or other structure that is arranged to fit over the hub 206 with the hub 206 received in a receiving hole of the device 1. The cap may include tabs, similar to the first and second tabs 65, 66, that can be received into slots at the receiving hole and lock the cap in place by twisting the cap, e.g., via a bayonet connection. This may lock the cap over the hub 206, securing the needle 200 in place on the device 1. Engagement of the cap may also fluidly couple a dispensing outlet of the cap with the opening 67 of the hub 206. For example, the end of a tube in the cap may fit within the opening 67 to sealingly engage with the hub 206 so beverage exiting the first lumen 201 passes to the dispensing outlet of the cap. In this embodiment, the body 61 includes a notch 68 that permits a portion of the dispensing outlet conduit that engages with the opening 67 (e.g., a tube) to extend away from the hub 206 in a direction transverse to the length of the needle 200. This may help reduce the overall height of the cap, but is not a required feature.

Another feature of the needle 200 is that the hub 206 is constructed and arranged to support the first and second lumens 201, 203 to penetrate through a cork of a wine bottle (or other closure of a beverage container) by inserting the distal ends of the first and second lumens 201, 203 through the cork while the needle 200 is supported only by the hub 206. Thus, the hub 206 may be engaged with the device 1, and the first and second lumens 201, 203 may extend away from the device 1 and be suitably supported to allow the first and second lumens 201, 203 to be inserted through a cork or other closure to access the container interior. As discussed above, passing the distal end of the needle 200 through a cork or other closure will put the first and second lumens 201, 203 in fluid communication with container interior via the first and second openings 204, 205. As shown in FIGS. 5, 6, 10 and 11, a single pointed end may be provided at the distal ends of the first and second lumens 201, 203 to aid in penetrating a cork or other closure.

Figure 9:
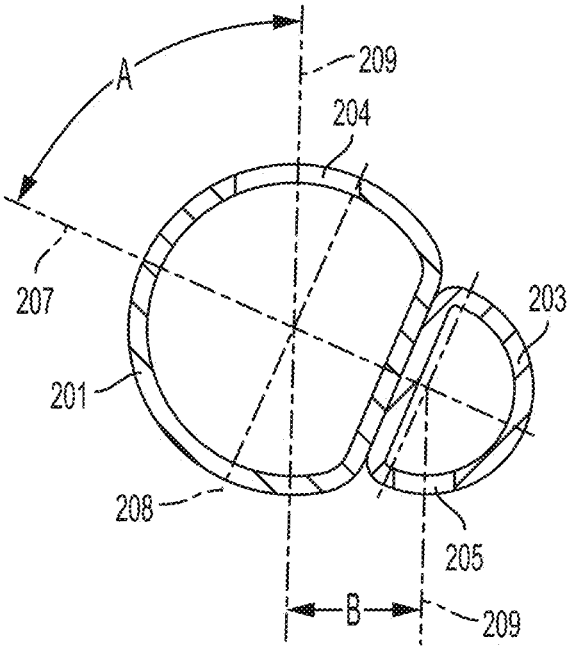
FIG. 9 shows a cross sectional view of the FIG. 5 needle along the line 9-9 in FIG. 6.
Figure 11:
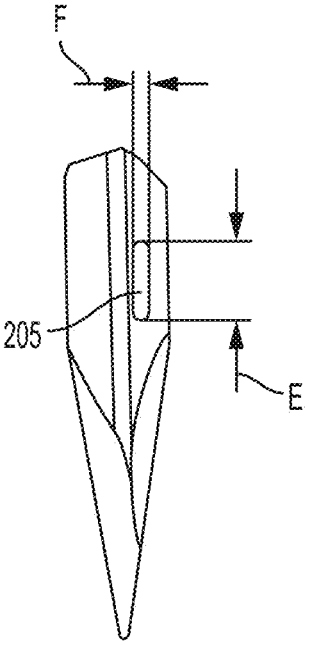
FIG. 11 shows a close up view of the second opening of the second lumen of the FIG. 5 needle.
Figure 10:
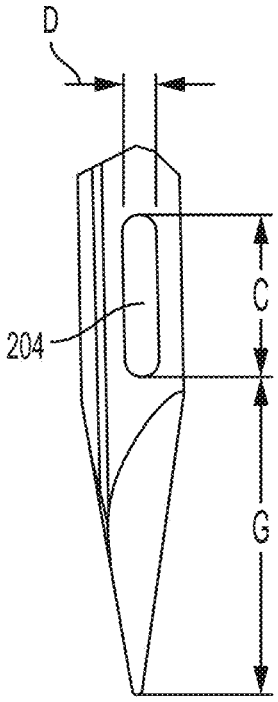
FIG. 10 shows a close up view of the first opening of the first lumen of the FIG. 5 needle.

In accordance with another aspect of the invention, and as can be seen in FIG. 9, the needle 200 includes the first and second openings 204, 205 on opposed sides of the needle 200 relative to each other. This positioning may help prevent gas that is exiting the second opening 205 from passing to the first opening 204 as beverage liquid is received into the first opening 204 to travel through the first lumen 201. As can also be seen in FIGS. 10 and 11, the first opening 204 is larger than the second opening 205, e.g., has a larger cross sectional area or length. The larger size of the first opening 204 may help reduce resistance to flow of liquid into the first lumen 201 and/or accommodate particles in the beverage that might clog a smaller opening. The smaller size of the second opening 205 may help resist passage of cork particles or other material into the first lumen 203, e.g., when penetrating a cork or other closure. As can also be seen in FIGS. 10 and 11, the first and second openings 204, 205 may be are elongated and extend in a direction along a length of the first and second lumens 201, 203. This configuration may help reduce the chance that the openings 204, 205 cut or otherwise remove portions of the cork or other closure as the needle 200 is passed through the closure while helping keep the total area of the openings 204, 205 relatively large in overall size. The first opening 204 may have a length C of about 3.3 mm and a width D of about 0.64 mm, and the second opening 205 may have a length E of about 1.6 mm and a width F of about 0.31 mm. The needle point may have a length G of about 6.5 mm. Although the openings 204, 205 are shown as formed by a single opening, the openings 204, 205 (and particularly the opening 205) may be formed by a plurality of holes, e.g., having a diameter of 0.15 mm or smaller, that together have approximately the same total area as a single hole opening 204, 205. This could aid in further prevention of cork or other particles entering either of the openings 204, 205.

In accordance with another aspect of the invention, and as can be seen in FIG. 9, the first and second lumens each have a respective D-shaped cross section with a flat surface, and the first and second lumens are attached together with the first and second flat surfaces in contact with each other. In this embodiment, the first lumen 201 has a cross sectional area that is larger than a cross sectional area of the second lumen, although as discussed above, the cross sectional areas may be the same or the second lumen may have a larger cross sectional area in some cases. As discussed more below, this arrangement of the first and second lumens 201, 203 may aid in penetrating a cork or other closure in a way that aids in resealing of the cork when the needle 200 is withdrawn. Alternately, or in addition, this arrangement may provide the first and second lumens 201, 203 with a suitably large cross sectional area while helping to keep the overall cross sectional dimensions of the needle 200 suitably small. This arrangement may also provide the needle 200 with a relatively robust spine or support portion where the flat sections of the first and second lumens 201, 203 are joined to provide the needle 200 with acceptable resistance to bending.

In accordance with another aspect of the invention, the first and second lumens together define a shape in cross section that is larger along a major axis than a minor axis that is perpendicular to the major axis. The inventors have found that a needle which has an overall circular cross sectional shape can cause damage to a cork or other closure that makes resealing of the cork difficult if the circular shape reaches a threshold diameter. However, the inventors have found that a needle may have a cross sectional shape with a dimension along a major axis that is larger than the threshold diameter and yet allow a cork to suitably reseal if the cross sectional shape has a dimension along a minor axis that is suitably less than the major axis dimension. That is, a needle can be constructed that allows for a cork to reseal and has a major dimension in cross section that is actually larger than a diameter of a circular cross section needle that does not allow a cork to reseal. In this illustrative embodiment, the needle 200 has a major dimension along a major axis 207 that is greater than a dimension along a minor axis 208 that is perpendicular to the major axis 207. In some cases, the major dimension may be larger than that of a circular cross section needle and yet allow a cork to reseal after penetration whereas the circular needle causes damage to the cork such that the cork cannot reseal. In this embodiment, the major axis 207 is perpendicular to the flat portions of the D-shaped cross sections of the first and second lumens 201, 203 and bisects the cross sections of the first and second lumens 201, 203 along a line of symmetry. The minor axis 208 is perpendicular to the major axis 207 and is located where the first lumen 201 has a greatest dimension in a direction parallel to the minor axis 207 (the minor dimension). A ratio of the dimension of the needle 200 along the major axis 207 to the dimension of the needle 200 along the minor axis 208 may be 1.25 to 1 or more, e.g., 2 to 1, 3 to 1, or 4 to 1.

In accordance with another aspect of the invention, the first and second openings 204, 205 of the first and second lumens 201, 203 may be centered or otherwise located on respective lines 209 arranged at an angle of 50 to 90 degrees to the major axis 207, e.g., at an angle of 60 to 70 degrees. As can be seen in FIG. 9, the first and second opening 204, 205 may be arranged on respective lines 209 that are parallel, are spaced by a distance B of about 0.7 mm, and extend at an angle A of about 67 degrees to the major axis 207. As can be seen, these respective lines 209 may place the openings 204, 205 on opposite sides of the needle 200. This positioning of the first and second openings 204, 205 away from the major dimension of the needle 200 along the major axis 207 may help prevent coring or cutting of the cork or other closure by the openings 204, 205 as the needle 200 is passed through the cork. That is, forces of the cork on the needle 200 will tend to be greatest at the major dimension, i.e., where the major axis 207 intersects the outer surface of the first and second lumens 201, 203 because the needle 200 has a largest dimension along this line. By positioning the openings 204, 205 away from the largest dimension of the needle cross section, forces of the cork on the openings 204, 205 will tend to be lower, helping to reduce the chance that cork will be forced into the openings 204, 205 during penetration by the needle 200. This may help prevent clogging the openings 204, 205 with cork particles, as well as help prevent damage to the cork and aid in resealing when the needle 200 is withdrawn. It should also be noted that in this embodiment, the lines 209 extend in a same direction in which the first and second tabs 65, 66 extend away from the hub body 61. This may position the openings 204, 205 in direction in which the tabs 65, 66 extend.

A needle 200 having a smooth walled exterior and a pencil point or Huber point may be effective to penetrate through a wine bottle cork or other closure, while sealing effectively with the cork to prevent the ingress or egress of gases or fluids during beverage extraction. Moreover, such needles allow the cork to reseal after withdrawal of the needle, allowing the container and any remaining beverage to be stored for months or years without abnormal alteration of the beverage flavor (such as when an inert or otherwise suitably non-reactive or low-reactive gas is injected into the container during dispensing). While multiple needle gauges can work, preferred needle gauges (e.g., corresponding to a dimension along a needle cross sectional major axis) range from 16 to 22 gauge (i.e., outer dimension of 1.65 mm to 0.91 mm), with an optimal needle gauge in some embodiments being between 17 and 20 gauge (i.e., outer dimension of 1.47 mm to 1.07 mm). These needle gauges may offer optimal fluid flow with minimal pressures inside the container while doing an acceptably low level of damage to the cork even after repeated insertions and extractions. Further, such needles may be used to penetrate a foil cover or other wrapping commonly found on wine bottles and other containers. Thus, the needle may penetrate the foil cover or other element as well as the closure, eliminating any need to remove the foil or other wrapping prior to beverage extraction. Other needle profiles and gauges are also usable with the system. In some arrangements, a needle need not be arranged to allow for cork resealing after removal. Instead, a needle may form an opening in a cork that is too large to allow the cork to reseal.

While in the above embodiments, a user moves the body 3 in a linear fashion relative to the base 2 to insert/remove a needle with respect to a container closure, a manual or powered drive mechanism may be used to move a needle relative to a closure. For example, a rail 31 may include a toothed rack, while the base 2 may include a powered pinion gear that engages the rack and serves to move the body 3 relative to the base 2. The pinion may be powered by a user-operated handle, a motor, or other suitable arrangement. In another embodiment, the needle may be moved by a pneumatic or hydraulic piston/cylinder, e.g., which is powered by pressure from the gas cylinder 100 or other source. Also, a body 3 and/or needle 200 need not be movable relative to a base 2 and clamp 4. Instead, the body 3 and/or needle 200 may be fixed relative to a clamp, e.g., a needle may be inserted through a cork and then the clamp 4 engaged with the container neck.

Multiple needle lengths can be adapted to work properly in various embodiments, but it has been found that a minimum needle length of about 1.5 inches is generally required to pass through standard wine bottle corks. Needles as long as 9 inches could be employed, but the optimal range of length for some embodiments has been found to be between 2 and 2.6 inches. (Needle length is the length of a needle that is operable to penetrate a closure and/or contact a needle guide for guidance in moving through the closure.) The needle may be fluidly connected to the valve directly through any standard fitting (e.g. NPT, RPT, Leur, quick-connect or standard thread) or alternatively may be connected to the valve through an intervening element such as a flexible or rigid tube. When two or more needles are used, the needle lengths may be the same or different and vary from 0.25 inches to 10 inches.

In some embodiments, a suitable gas pressure is introduced into a container to extract beverage from the container. For example, with some wine bottles, it has been found that a maximum pressure of between around 40 and 50 psi may be introduced into the bottle without risking leakage at, or ejection of, the cork, although pressures of between around 15 and 30 psi have been found to work well. These pressures are well tolerated by even the weakest of cork-to-bottle seals at the bottle opening without causing cork dislodging or passage of liquid or gas by the cork, and provide for relatively fast beverage extraction. The lower pressure limit in the container during wine extraction for some embodiments has been found to be between about 0 and 20 psi. That is, a pressure between about 0 and 20 psi has been found needed in a bottle to provide a suitably fast extraction of beverage from the bottle. In one example, a pressure of 30 psi was used to establish an initial pressure in a wine bottle, and rapid wine extraction was experienced even as the internal pressure dropped to about 15-20 psi.

The source of pressurized gas can be any of a variety of regulated or unregulated pressurized gas containers filled with any of a variety of non-reactive gasses. In a preferred embodiment, the gas cylinder contains gas at an initial pressure of about 2000-3000 psi. This pressure has been found to allow the use of a single relatively small compressed gas cylinder (e.g., about 3 inches in length and 0.75 inches in diameter) for the complete extraction of the contents of several bottles of wine. Multiple gasses have been tested successfully over extended storage periods, and preferably the gas used is non-reactive with the beverage within the container, such as wine, and can serve to protect the beverage oxidation or other damage. Suitable gases include nitrogen, carbon dioxide, argon, helium, neon and others. Mixtures of gas are also possible. For example, a mixture of argon and another lighter gas could blanket wine or other beverage in argon while the lighter gas could occupy volume within the bottle and perhaps reduce the overall cost of the gas.

While aspects of the invention have been shown and described with reference to illustrative embodiments, it will be understood by those skilled in the art that various changes in form and details may be made therein without departing from the scope of the invention encompassed by the appended claims.

Also, the phraseology and terminology used herein is for the purpose of description and should not be regarded as limiting. The use of "including," "comprising," or "having," "containing," "involving," and variations thereof herein, is meant to encompass the items listed thereafter and equivalents thereof as well as additional items.

The invention claimed is:

1. A needle for accessing a beverage in a container, comprising:

a first lumen having a first cross sectional size and a first D-shaped cross section with a first flat surface;

a second lumen having a second cross sectional size and a second D-shaped cross section with a second flat surface, the second cross sectional size being smaller than the first cross sectional size, the first and second lumens each extending from a proximal end to a distal end and being attached together with the first and second flat surfaces in contact with each other; and a hub attached at the proximal ends of the first and second lumens, the hub being arranged to connect the first and second lumens to a beverage dispenser and put at least one of the first and second lumens in fluid communication with a portion of the beverage dispenser.

2. The needle of claim 1, further comprising a pointed end at the distal ends of the first and second lumens.

3. The needle of claim 2, wherein the first and second lumens are constructed and arranged to penetrate through a cork of a wine bottle by inserting the pointed end through the cork.

4. The needle of claim 1, wherein the first lumen includes a first opening at a distal end of the first lumen to receive beverage liquid into the first lumen, and the second lumen includes a second opening at a distal end of the second lumen to deliver gas into the container.

5. The needle of claim 4, wherein the first and second openings are on opposed sides of the needle relative to each other.

6. The needle of claim 4, wherein the first and second lumens define a cross sectional shape with a major axis that is perpendicular to the first and second flat surfaces and extends along a largest dimension of the cross sectional shape, where the cross sectional shape is as viewed in a plane perpendicular to a length of the first and second lumens, and wherein the first and second openings are located on respective lines arranged at an angle of 50 to 90 degrees to the major axis.

7. The needle of claim 6, wherein the first and second openings are centered on respective lines arranged at an angle of 60 to 70 degrees to the major axis.

8. The needle of claim 4, wherein the first opening is larger than the second opening.

9. The needle of claim 4, wherein the first and second openings are elongated and extend in a direction along a length of the first and second lumens.

10. The needle of claim 1, wherein the hub includes a body with a gas port that extends through the body and fluidly communicates with the second lumen.

11. The needle of claim 10, wherein the hub includes a first gasket positioned distal of the gas port and a second gasket positioned proximal of the gas port.

12. The needle of claim 1, wherein the hub includes a body with forward and rear tabs that extend away from each other in a direction perpendicular to a length of the first and second lumens.

13. The needle of claim 12, wherein the forward tab is longer than the rear tab.

14. The needle of claim 1, wherein the hub includes a body with an opening at a proximal end of the body, the opening being in fluid communication with the first lumen.

15. The needle of claim 1, wherein the hub is constructed and arranged to support the first and second lumens to penetrate through a cork of a wine bottle by inserting the distal ends of the first and second lumens through the cork.

16. A needle for accessing a beverage in a container, comprising:

a first lumen and a second lumen attached to the first lumen, the first and second lumens together defining a cross sectional shape and extending from a proximal end to a distal end;

the cross sectional shape having a major dimension along a major axis and a minor dimension along a minor axis that is perpendicular to the major axis, the minor dimension being smaller than the major dimension;

wherein the needle is configured to be inserted through a cork of a wine bottle along a pathway such that the distal end of the first and second lumens passes entirely through the cork, the needle configured to allow the cork to reseal to resist passage of fluid through the pathway upon withdrawal of the needle from the cork.

17. The needle of claim 16, further comprising:

a hub attached at the proximal ends of the first and second lumens, the hub being arranged to connect the first and second lumens to a beverage dispenser and put at least one of the first and second lumens in fluid communication with a portion of the beverage dispenser.

18. The needle of claim 16, wherein the first lumen includes a first opening at a distal end of the first lumen to receive beverage liquid into the first lumen, and the second lumen includes a second opening at a distal end of the second lumen to deliver gas into the container.

19. The needle of claim 18, wherein the first and second openings are on opposed sides of the needle relative to each other.

* * * * *